US009564720B2

(12) United States Patent
Zhang

(10) Patent No.: US 9,564,720 B2
(45) Date of Patent: Feb. 7, 2017

(54) RETRACTABLE POWER PLUG

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Yi-Xiang Zhang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/725,911

(22) Filed: May 29, 2015

(65) Prior Publication Data

US 2016/0181726 A1 Jun. 23, 2016

(30) Foreign Application Priority Data

Dec. 19, 2014 (CN) ..... 2014 2 0807649

(51) Int. Cl.
*H01R 13/443* (2006.01)
*H01R 24/30* (2011.01)
*H01R 103/00* (2006.01)

(52) U.S. Cl.
CPC ..... *H01R 24/30* (2013.01); *H01R 2103/00* (2013.01)

(58) Field of Classification Search
CPC ..... H01R 13/60; H01R 24/30; H01R 2105/00
USPC ..... 439/131, 446, 640, 172
See application file for complete search history.

(56) References Cited

U.S. PATENT DOCUMENTS

| | | | | |
|---|---|---|---|---|
| 7,798,825 | B1 * | 9/2010 | Pai | H01R 31/06 439/131 |
| 8,308,496 | B2 * | 11/2012 | Youssefi-Shams | H01R 13/44 439/172 |
| 8,366,461 | B2 * | 2/2013 | Lee | H01R 24/30 439/131 |
| 9,077,093 | B1 * | 7/2015 | Roy | H02K 49/10 |
| 2005/0106908 | A1 * | 5/2005 | Sakai | H01R 35/04 439/131 |
| 2005/0287827 | A1 * | 12/2005 | Liao | H01R 35/04 439/11 |
| 2006/0046541 | A1 * | 3/2006 | Bhutani | H01R 35/04 439/131 |
| 2009/0029581 | A1 * | 1/2009 | Klant | H01R 31/06 439/222 |
| 2009/0093163 | A1 * | 4/2009 | Tsai | H01R 13/502 439/620.21 |
| 2011/0097914 | A1 * | 4/2011 | Lee | H01R 29/00 439/174 |

(Continued)

*Primary Examiner* — Abdullah Riyami
*Assistant Examiner* — Nelson R Burgos-Guntin
(74) *Attorney, Agent, or Firm* — Zhigang Ma

(57) ABSTRACT

A retractable power plug includes a housing having an opening formed therein, a mounting portion fixed in the housing, a plurality of pins, and a cover plate. The pins are rotatably mounted on the mounting portion. The cover plate at least partially cover the opening and defines a plurality of receiving grooves corresponding to the pins. The plurality of pins are configured in a first configuration and protrude out of the receiving grooves and in a second configuration to be within the plurality of receiving grooves. The cover plate further defines at least one recess on a sidewall of one of the plurality of receiving grooves, thereby enabling the pin to be retracted.

18 Claims, 2 Drawing Sheets

(56) References Cited

U.S. PATENT DOCUMENTS

| | | | | |
|---|---|---|---|---|
| 2013/0040479 | A1* | 2/2013 | Hsu | H01R 35/04 439/171 |
| 2013/0316553 | A1* | 11/2013 | Lee | H01R 35/04 439/131 |
| 2014/0057468 | A1* | 2/2014 | Temmesfeld | B60L 11/1818 439/133 |
| 2014/0199867 | A1* | 7/2014 | Rogers | H01R 27/00 439/173 |
| 2015/0038019 | A1* | 2/2015 | Lee | H01R 31/02 439/640 |
| 2015/0118873 | A1* | 4/2015 | Loh | H01R 24/66 439/131 |
| 2015/0229061 | A1* | 8/2015 | Hsu | H01R 13/44 439/131 |
| 2015/0364882 | A1* | 12/2015 | Roy | H01R 13/434 439/131 |

* cited by examiner

RETRACTABLE POWER PLUG

FIELD

The subject matter herein generally relates to a retractable power plug.

BACKGROUND

Power plugs are commonly used to supply power to electronic devices, such as mobile phones. A conventional power plug includes a housing, a cover plate, and a plurality of pins mounted in the housing and partially protruding out of the housing.

BRIEF DESCRIPTION OF THE DRAWINGS

Implementations of the present technology will now be described, by way of example only, with reference to the attached figures.

DETAILED DESCRIPTION

Figure 1:
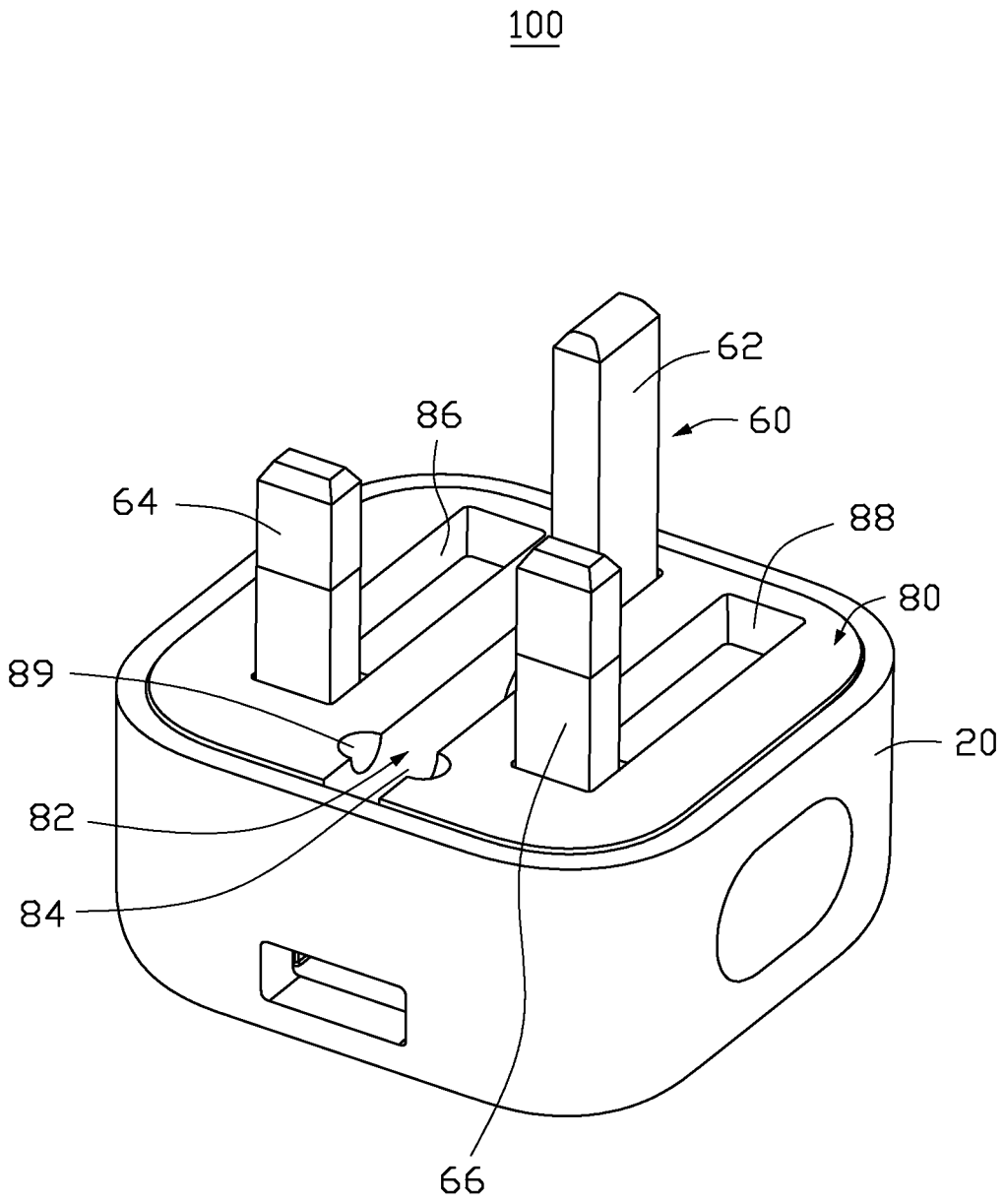
FIG. 1 is an isometric view of one embodiment of a retractable power plug.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. The term "comprising" when utilized, means "including, but not necessarily limited to"; it specifically indicates open-ended inclusion or membership in the so-described combination, group, series and the like.

The present disclosure is described in relation to a retractable power plug.

FIG. 1 illustrates that a retractable power plug 100 includes a housing 20, a plurality of pins 60, and a cover plate 80 covering the housing 20. In at least one embodiment, the pins 60 can be mounted in the housing 20 and partially protruded out of the cover plate 80. The cover plate 80 can define a plurality receiving grooves 82 corresponding to the pins 60 and configured to accommodate the pins 60, and the pins 60 can be configured in a first configuration and protrude out of the receiving grooves 82. The pins 60 can be further configured in a second configuration to be within the receiving grooves 82.

In at least one embodiment, the receiving groove 82 can include a first receiving groove 84, a second receiving groove 86, and a third receiving groove 88 spaced from each other. The second receiving groove 86 and the third receiving groove 88 can be arranged at two sides of the first receiving groove 84 and substantially parallel with the first receiving groove 84. The pins 60 can include a first pin 62, a second pin 64, and a third pin 66 spaced from each other. When the first pin 62, the second pin 64 and the third pin 66 are substantially perpendicular to the cover plate 80, the first pin 62 can be located at one terminal of the first receiving groove 84, and the second pin 64 and the third pin 66 can be respectively located at the terminals of the second receiving groove 86 and the third receiving groove 88, and both opposite to the first pin 62.

A surface of the cover plate 80 away from the housing 20 can define at least one recess 89. The recess 89 can be defined at a sidewall of the receiving groove 82 and in communication with the receiving groove 82, thus the recess 89 and the receiving groove 82 can cooperatively form an accommodating space, and the pin 60 can be taken out of receiving groove 82 conveniently by finger. In at least one embodiment, the number of the recesses 89 are two, and the two recesses 89 are defined in the first receiving groove 84 and facing each other.

Figure 2:
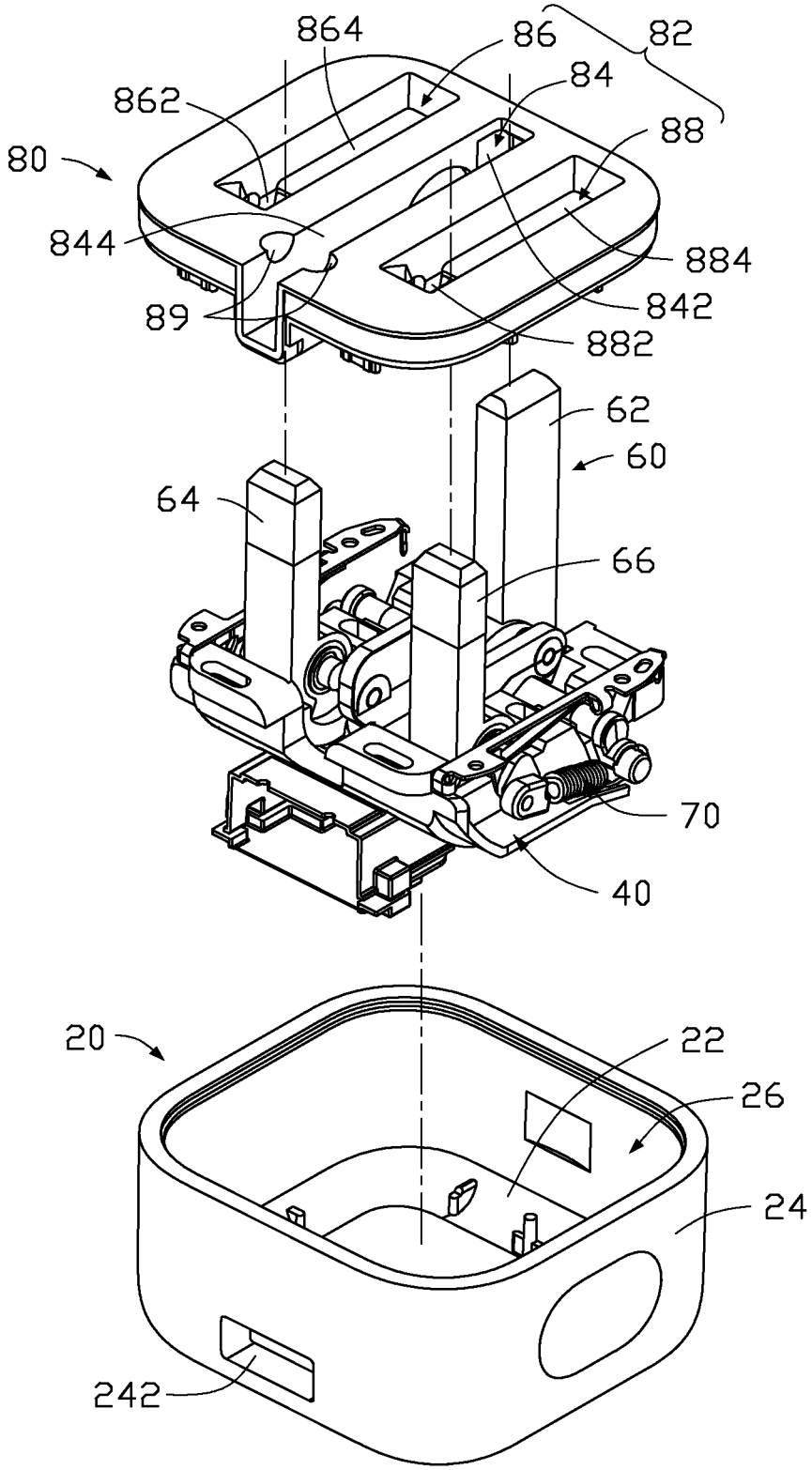
FIG. 2 is an exploded isometric view of the retractable power plug shown in FIG. 1.

FIG. 2 illustrates that the housing 20 can include a base 22 and a plurality of side walls 24 extending substantially vertically from the base 22. The housing 20 can have an opening 26 formed therein, and the cover plate 80 can at least partially cover the opening 26. One of the side walls 24 can define a Universal Serial Bus (USB) interface 242, thus a wire (not shown) can be inserted into the USB interface 242, and the retractable power plug 100 can be coupled to an external device.

The retractable power plug 100 can further include a mounting portion 40 received in the housing 20. Each pin 60 can be rotatably mounted on the mounting portion 40. In at least one embodiment, the mounting portion 40 can be fixed at the base 22.

The first pin 62, the second pin 64, and the third pin 66 can rotate relative to the mounting portion 40. A free end portion of each pin 60 can rotate relative to the mounting portion 40, and the other end of each pin 60 can be mounted on the mounting portion 40. When the pins 60 are fallen down, the pins 60 can be parallel with a bottom portion of the receiving grooves and received in the receiving grooves 82. The retractable power plug 100 can further include two linkages 70. The first pin 62 can be coupled to the second pin 64 and the third pin 66 through the linkages 70, thus the second pin 64 and the third pin 66 can rotate with the first pin 62 when the first pin 62 rotates. In at least one embodiment, the first pin 62 can be a ground pin, the second pin 64 can be a neutral pin, and the third pin 66 can be a live pin.

The cover plate 80 can cover one end portion of the side wall 24 away from the base 22. In at least one embodiment, the first receiving groove 84 can include a first through hole 842 and a first recess portion 844 in communication with each other. The first pin 62 can get through the through hole 842. The recess 89 can be defined at one end portion of a sidewall of the first recess portion 844 away from the first through hole 842, and the two recesses 89 and the first recess portion 844 can form the accommodating space, thus the free end of the first pin 62 can be rotated relative to the housing 20 when stirred by a finger in the accommodating space. In at least one embodiment, the two recesses 89 can be symmetrically arranged at two opposite sidewalls of the receiving groove 84. In at least one embodiment, the recess 89 can be a quarter of a spherical. In other embodiments, the recess 89 can be oval, square, or other shape. The second receiving groove 86 and the third receiving groove 88 can have a similar structure with the first receiving groove 84. The second receiving groove 86 can include a second through hole 862 and a second recess portion 864, and the third receiving groove 86 can include a third through hole 882 and a third recess portion 884. The second through hole 862 and the third through hole 882 can be arranged adjacent to the recess 89.

In assembling, the mounting portion 40 can be fixed in the base 22 of the housing 20, and the first pin 62, the second pin 64, and the third pin 66 can be rotatably mounted on the mounting portion 40. Then, the first pin 62 can be connected to the second pin 64 and the third pin 66 by the two linkages 70. After that, the cover plate 80 can be placed above the housing 20, and the first pin 62, the second pin 64, and the third pin 66 can get through the corresponding receiving groove 82.

In use, the retractable power plug 100 can be connected to an external socket (not shown) for supplying power to a mobile terminal or other electronic device. User can stir the first pin 62 in the recess 89, thus the first pin 62 can rotate relative to the housing 20, and the second pin 64 and the third pin 66 can rotate with the first pin 62, until the first pin 62, the second pin 64, and the third pin 66 are substantially perpendicular to the cover plate 80 and protrude out of the receiving grooves 82. At this time, the retractable power plug 100 can be coupled to the external socket. When the retractable power plug 100 is no longer used, the first pin 62 can be retracted, and the second pin 64 and the third pin 66 can rotate with the first pin 62, until the first pin 62, the second pin 64, and the third pin 66 are substantially parallel to the receiving groove 82 and received in the receiving grooves 82. At this time, the retractable power plug 100 having a smaller volume is convenient to carry.

The recess 89 of the retractable power plug 100 of this disclosure can be defined in the cover plate 80, so it is convenient to stir the pin 60. Further more, the recess 89 defined in the cover plate 80 would not decrease a strength of the retractable power plug 100, and the retractable power plug 100 is not be easy to deformation when being hit.

In other embodiments, the numbers of the pins 60 is not limited to three. When the retractable power plug 100 is an ambipolar power plug, the number of the pins 60 and the receiving groove 82 can be two. In other embodiments, the mounting portion 40 can be fixed at the side wall 24 of the housing 20. The recess 89 can be defined at one side of the receiving groove 82.

The embodiments shown and described above are only examples. Many details are often found in the art such as the other features of a retractable power plug. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including, the full extent established by the broad general meaning of the terms used in the claims. It will therefore be appreciated that the embodiments described above may be modified within the scope of the claims.

What is claimed is:

1. A retractable power plug comprising:

a housing having an opening formed therein;

a mounting portion immovably fixed in the housing;

a plurality of pins rotatably mounted on the mounting portion; and a cover plate separably mounted on the housing and at least partially covering the opening and defining a plurality of receiving grooves corresponding to the pins;

wherein the plurality of pins are configured in a first configuration and protrude out of the receiving grooves and in a second configuration to be within the plurality of receiving grooves; and wherein the cover plate further defines at least one recess on a sidewall of one of the plurality of receiving grooves, thereby enabling the pin to be retracted.

2. The retractable power plug as claimed in claim 1, wherein the plurality of pins comprises a first pin, a second pin, and a third pin spaced from each other, and the retractable power plug further comprises two linkages mounted on the mounting portion; and wherein the first pin is coupled to the second pin and the third pin by the two linkages, and the second pin and the third pin are capable of rotating with the first pin.

3. The retractable power plug as claimed in claim 2, wherein the plurality of receiving grooves comprises a first receiving groove, a second receiving groove, and a third receiving groove; the second receiving groove and the third receiving groove are positioned at two sides of the first receiving groove and substantially parallel with the first receiving groove;

wherein the first pin is received in the first receiving groove, the second pin is received in the second receiving groove, and the third pin is received in the third receiving groove; and wherein the at least one recess is defined in a sidewall of the first receiving groove and in communication with the first receiving groove.

4. The retractable power plug as claimed in claim 2, wherein the first pin is a ground pin, the second pin is a neutral pin, and the third pin is a live pin.

5. The retractable power plug as claimed in claim 1, wherein the number of the recesses are two, and the two recesses are symmetrically arranged at two sidewall of one of the plurality of the receiving groove.

6. The retractable power plug as claimed in claim 1, wherein each of the receiving grooves comprises a through hole and a recess portion in communication with each other, and the through hole runs through the cover plate; and wherein the pin gets through the through hole, and the recess is defined at one end portion of the recess portion away from the through hole.

7. The retractable power plug as claimed in claim 1, wherein the recess is a quarter of a spherical.

8. The retractable power plug as claimed in claim 1, wherein the housing comprises a base and a plurality of side walls extending substantially vertically from the base, and one side wall defines a Universal Serial Bus interface.

9. A retractable power plug comprising:

a housing having an opening formed therein;

a mounting portion immovably fixed in the housing;

a plurality of pins rotatably mounted on the mounting portion; and a cover plate separably mounted on the housing and at least partially covering the opening and defining a plurality of receiving grooves corresponding to the pins;

wherein the first pin, the second pin and the third pin are configured in a first configuration and corresponding protrude out of the first receiving groove, the second receiving groove and the third receiving groove;

wherein the first pin, the second pin and the third pin are configured and in a second configuration to be corresponding within the first receiving groove, the second receiving groove and the third receiving groove;

wherein the cover plate further defines at least one recess on a sidewall of the first receiving groove, thereby enabling the pin to be retracted;

wherein the first pin is stirred in the recess, the first pin rotates relative to the housing, and the second pin and the third pin rotate with the first pin.

10. The retractable power plug as claimed in claim 9, further comprising two linkages mounted on the mounting portion; and wherein the first pin is coupled to the second pin and the third pin by the two linkages, and the second pin and the third pin are capable of rotating with the first pin.

11. The retractable power plug as claimed in claim 9, wherein the second receiving groove and the third receiving groove are positioned at two sides of the first receiving groove and substantially parallel with the first receiving groove.

12. The retractable power plug as claimed in claim 9, wherein the first pin is a ground pin, the second pin is a neutral pin, and the third pin is a live pin.

13. The retractable power plug as claimed in claim 9, wherein he number of the recesses are two, and the two recesses are symmetrically arranged at two sidewall of the first receiving groove.

14. The retractable power plug as claimed in claim 9, wherein the recess is a quarter of a spherical.

15. The retractable power plug as claimed in claim 9, wherein the recess is defined on a surface of the cover plate away from the housing.

16. The retractable power plug as claimed in claim 9, wherein the first receiving groove comprises a first through hole and a first recess portion in communication with each other, the first pin gets through the first through hole; and wherein the recess is defined at one end portion of a sidewall of the first recess portion away from the first through hole.

17. The retractable power plug as claimed in claim 16, wherein the second receiving groove comprises a second through hole and a second recess portion in communication with each other, the second pin gets through the second through hole; and wherein the second through hole is arranged adjacent to the recess, and the second recess portion is away from the recess.

18. The retractable power plug as claimed in claim 17, wherein the third receiving groove comprises a third through hole and a third recess portion in communication with each other, the third pin gets through the third through hole; and wherein the third through hole is arranged adjacent to the recess, and the third recess portion is away from the recess.

* * * * *